US010023209B2

(12) United States Patent
Kulikov

(10) Patent No.: US 10,023,209 B2
(45) Date of Patent: Jul. 17, 2018

(54) MULTI-TRACK ROTATIONAL RAILWAY JUNCTION

(71) Applicant: Valentin I. Kulikov, Moscow (RU)

(72) Inventor: Valentin I. Kulikov, Moscow (RU)

( * ) Notice: Subject to any disclaimer, the term of this patent is extended or adjusted under 35 U.S.C. 154(b) by 149 days.

(21) Appl. No.: 14/392,400

(22) PCT Filed: Nov. 28, 2013

(86) PCT No.: PCT/RU2013/001073
§ 371 (c)(1),
(2) Date: May 10, 2016

(87) PCT Pub. No.: WO2015/069136
PCT Pub. Date: May 14, 2015

(65) Prior Publication Data

US 2016/0272226 A1 Sep. 22, 2016

(30) Foreign Application Priority Data

Nov. 11, 2013 (RU) ..... 2013150142

(51) Int. Cl.
*B61J 1/04* (2006.01)
*E01B 7/28* (2006.01)
*B61J 1/02* (2006.01)
*B61J 99/00* (2006.01)

(52) U.S. Cl.
CPC . *B61J 1/04* (2013.01); *B61J 1/02* (2013.01); *B61J 99/00* (2013.01); *E01B 7/28* (2013.01)

(58) Field of Classification Search
CPC ..... B61J 1/00; B61J 1/02; B61J 1/04; B61J 1/10; B61J 1/12
See application file for complete search history.

(56) References Cited

U.S. PATENT DOCUMENTS

2010/0147183 A1* 6/2010 Weissbrodt ..... B61J 1/02 104/307

* cited by examiner

*Primary Examiner* — Robert J McCarry, Jr.

(57) ABSTRACT

A method and system for a rotational multi-track railway switch-junction. The rotational multi-track railway junction comprises one or more incoming tracks and a plurality of outgoing tracks connected by a rotating platform to a plurality of stationary track sections. The rotational platform provides a connection between at least one of the incoming tracks and at least one of the outgoing tracks and can be automatically controlled and locked in a given position. Thus, costs and an overall size of a railway junction are reduced.

10 Claims, 5 Drawing Sheets

MULTI-TRACK ROTATIONAL RAILWAY JUNCTION

CROSS-REFERENCE TO RELATED APPLICATION

This Application is a US National Phase of PCT/RU2013/001073 filed on Nov. 28, 2013.

BACKGROUND OF THE INVENTION

Field of the Invention

This invention relates to a method and system for implementing a railway junction, and more particularly, to an automated rotational platform for the railway switch-junction.

Description of the Related Art

This invention relates to a method and system for implementing a railway junction, and more particularly, to an automated rotational platform for the railway switch-junction.

Conventional railway junctions may have up to fifteen outgoing railway tracks and one or more incoming tracks connected by a switching mechanism. Such railway junction is implemented as a sequence of standard railway switches that create a railway "street junction" used for redirecting one railway track into several to choose from. This arrangement is used at large railway stations and hubs having up to 20 different railway track lines or at a railway depot.

The main shortcoming of a conventional railway "street junction" is a large area occupied by the railway junctions. The railway stations (or hubs) require hundreds of yards of the railway lines for providing efficient splitting of one incoming track into multiple tracks leading to different railway platforms. Additionally, hundreds of yards of railways are required in order to combine these lines back into one (or two) outgoing track. As a result, the railways leading in and going out stations can take up over 2 miles of additional rails.

Another shortcoming of the conventional railway junctions and interchanges is reliability. The railway switches have a relatively short lifespan and require extensive regular services, especially in northern areas in winter period. These services include application of special oils (which have negative effect on environment) and snow (or dirt) removal in order to avoid icing and rusting of the parts of the switch, which can get stuck and become unusable due to dirt, rust, snow and ice. Furthermore, the individual railway switches forming the "street junction" are assembled outside and require difficult mounting procedures and precise configurations. Regular additional configuration adjustments are also required.

Accordingly, a universal automated railway switch-junction, which overcomes the shortcomings of the conventional ones, is desired.

SUMMARY OF THE INVENTION

Accordingly, the present invention is directed to a system and method for automated rotational railway switch-junction that substantially obviates one or more of the disadvantages of the related art.

In one aspect of the invention, a system for a rotational multi-track railway switch-junction is provided. A rotational multi-track railway switch-junction comprises one or more incoming tracks and a plurality of outgoing tracks connected by a rotating platform to a plurality of stationary track sections. The rotational platform provides a connection between at least one of the incoming tracks and at least one of the outgoing tracks and can be automatically controlled and locked in a given position. Thus, costs and an overall size of a railway switch-junction are reduced.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
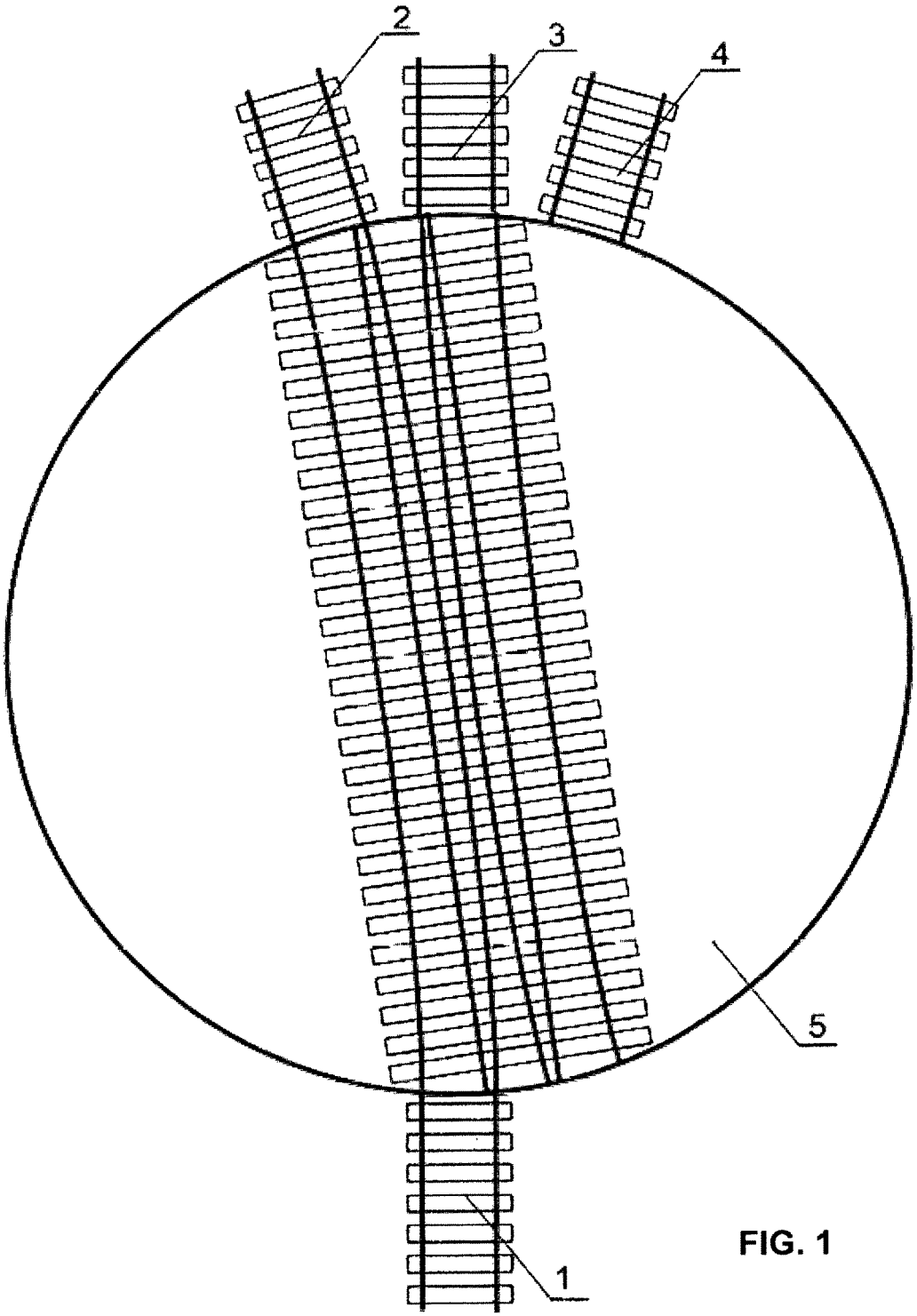
FIGS. 1, 2 and 3 illustrate a top view of a rotational platform of the switch-junction shown in different positions, in accordance with the exemplary embodiment.

Reference will now be made in detail to the preferred embodiments of the present invention, examples of which are illustrated in the accompanying drawings.

In one embodiment, a method and system for an automated railway junction are provided. A rotational multi-track railway switch-junction comprises one or more incoming tracks and a plurality of outgoing tracks connected by a rotating platform to a plurality of stationary track sections. The rotational platform provides a connection between at least one of the incoming tracks and at least one of the outgoing tracks and can be automatically controlled and locked in a given position. Thus, costs and an overall size of a railway junction are reduced.

According to an exemplary embodiment, one incoming railway (or tram) line can be split into three or more lines. In the preferred embodiment, a split-junction is implemented as a base having a rotational platform and a rotation motor. This novel arrangement, advantageously, allows for switching between the railway tracks by rotating the platform so the different tracks can be connected. The base and a rotation platform are implemented as one unit, which can be easily assembled on the production line and just as easily deployed on the railways site. The rotational junction unit can be assembled and tested at the factory and, then, placed at the required position at the railroad tracks.

According to the exemplary embodiment, the rotational platform has a plurality of the railroad tracks so that once turned into any of possible positions, the platform connects at least one incoming track to at least one outgoing track. One incoming track can be connected to one of a plurality of the outgoing tracks just by one simple movement of the rotational platform, which can be automatically locked in the desired position.

The rotational platform eliminates a possibility of disjoined railway tracks at a point of the split of the tracks. Also, a possibility of moving the switch by the force of the incoming train, which ran the red light, is completely eliminated. This prevents the train crashes caused by inefficient conventional switches. Each of the railway tracks located on the rotation platform is implemented as a conventional pair of rails and does not require any special materials or parts. In one embodiment, the tracks located on the rotational platform can be implemented as embedded grooves configured for standard wheels of a railway car. This embodiment provides for implementing ten and more intercepting tracks on the same rotational platform.

According to the exemplary embodiment, the platform can be automatically rotated to a desired angle and can be locked into position by the rotation motor. The motor can be controlled remotely via an automation control center. The rotational platform has several positioning and motion sensors providing data to the control center. Thus, positioning of the rotational platform can be checked and controlled remotely. The rotational platform has a signaling unit configured to provide positioning signals to the control center. The signaling unit can also provide the positioning data not only to the dispatchers, but to the railway car operators as well.

According to the exemplary embodiment, the rotational platform can be moved by mechanical, electrical or hydraulically-driven means. Thus, the rotational platform can be moved manually in case of a loss of power. In one embodiment, the rotational platform can be placed over a layer of special liquid (e.g., oil). A compressor pumps the oil under the platform, which rises as a result and easily rotates to a desired angle. Then, the oil pressure is reduced and the platform is lowered into the position. A rheological emulsion can be used as a liquid used underneath the rotational platform. The rheological emulsion can turn into a solid state under the application of the electric current. Thus, it can be used for locking the platform into a desired position.

According to the exemplary embodiment, the rotational platform is implemented as a circular disk, which rotates about an axis located at its center. However, the rotational platform can have an arbitrary asymmetrical shape as well. In one embodiment, the rotational platform can be connected to the base via a plurality of rollers or bearings located along its perimeter. Thus, the platform can move smoothly when being repositioned (i.e., rotated).

In one embodiment, the platform can be locked into a position by a cone-shaped or cylindrical-shaped pin located on the platform, which fits into a plurality of holes implemented on the base. The pins can be controlled by a magnet. Alternatively, the rotational platform can be locked into position by a set of spheres (e.g., metal balls) located between the platform and the base and by a set of depressions located on the base.

Figure 2:
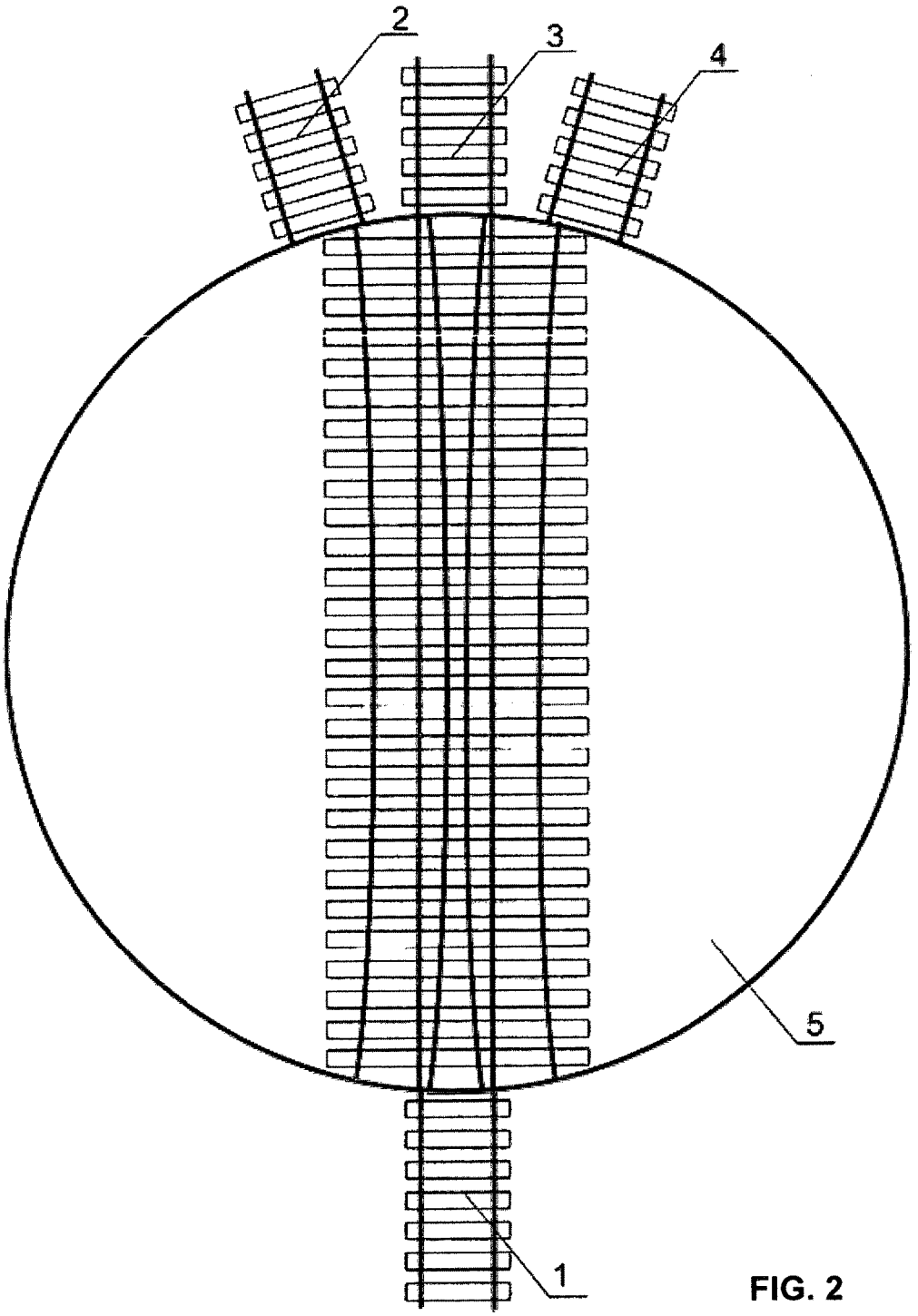
Figure 3:
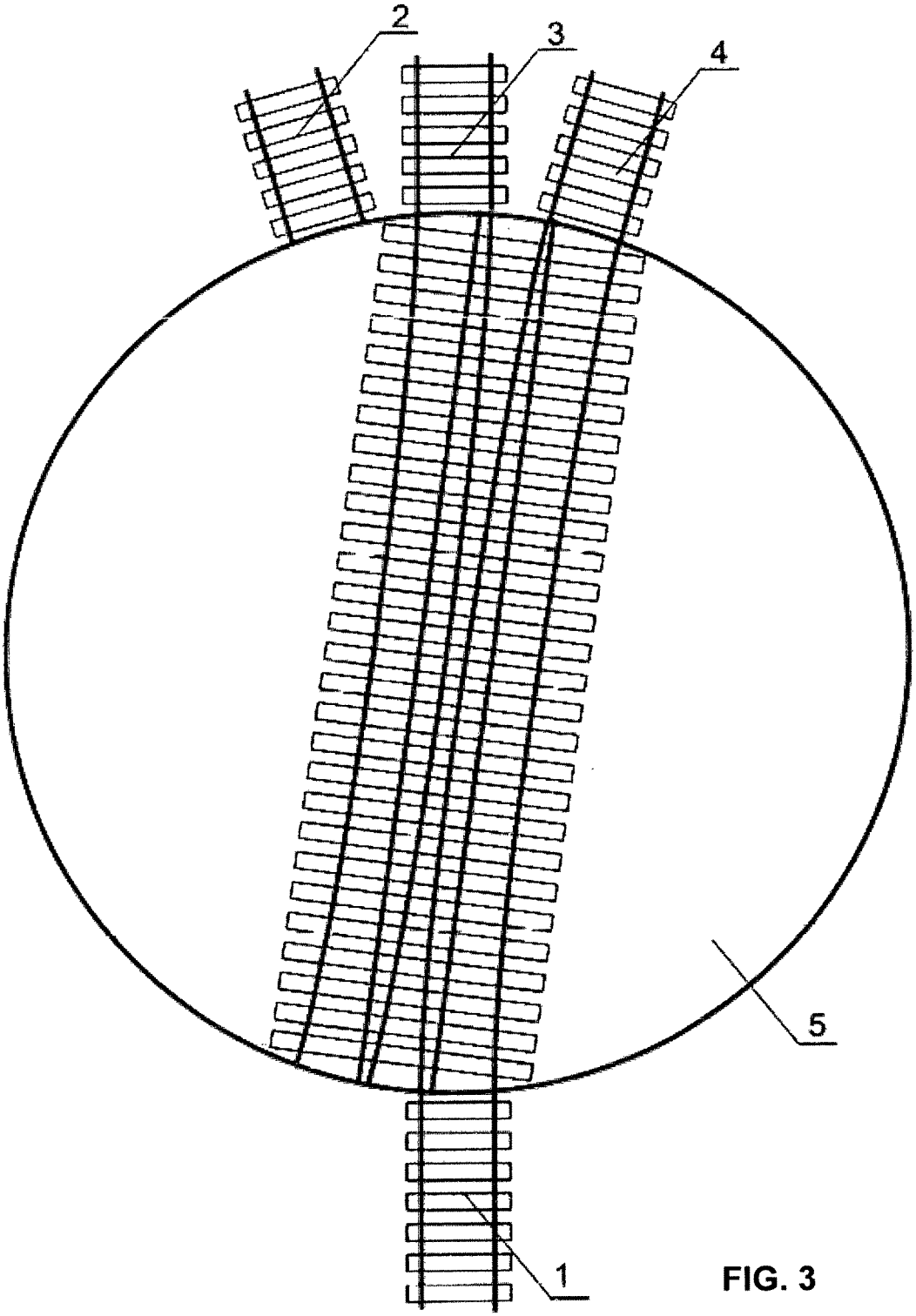

FIGS. 1, 2 and 3 illustrate a top view of a rotational platform shown in different positions, in accordance with the exemplary embodiment. In these FIGs., one (or more) incoming track 1 is directed to one of three possible choices of the outcoming tracks—2, 3 and 4. As can be clearly seen, the rotation of the platform 5 determines which of the outcoming tracks (2, 3 and 4) is connected to the incoming track 1. For example, in FIG. 1, the track 1 is connected to the outcoming track 2. In FIG. 2, the track 1 is connected to the outcoming track 3 and, in FIG. 3, the track 1 is connected to the outcoming track 4.

Figure 4:
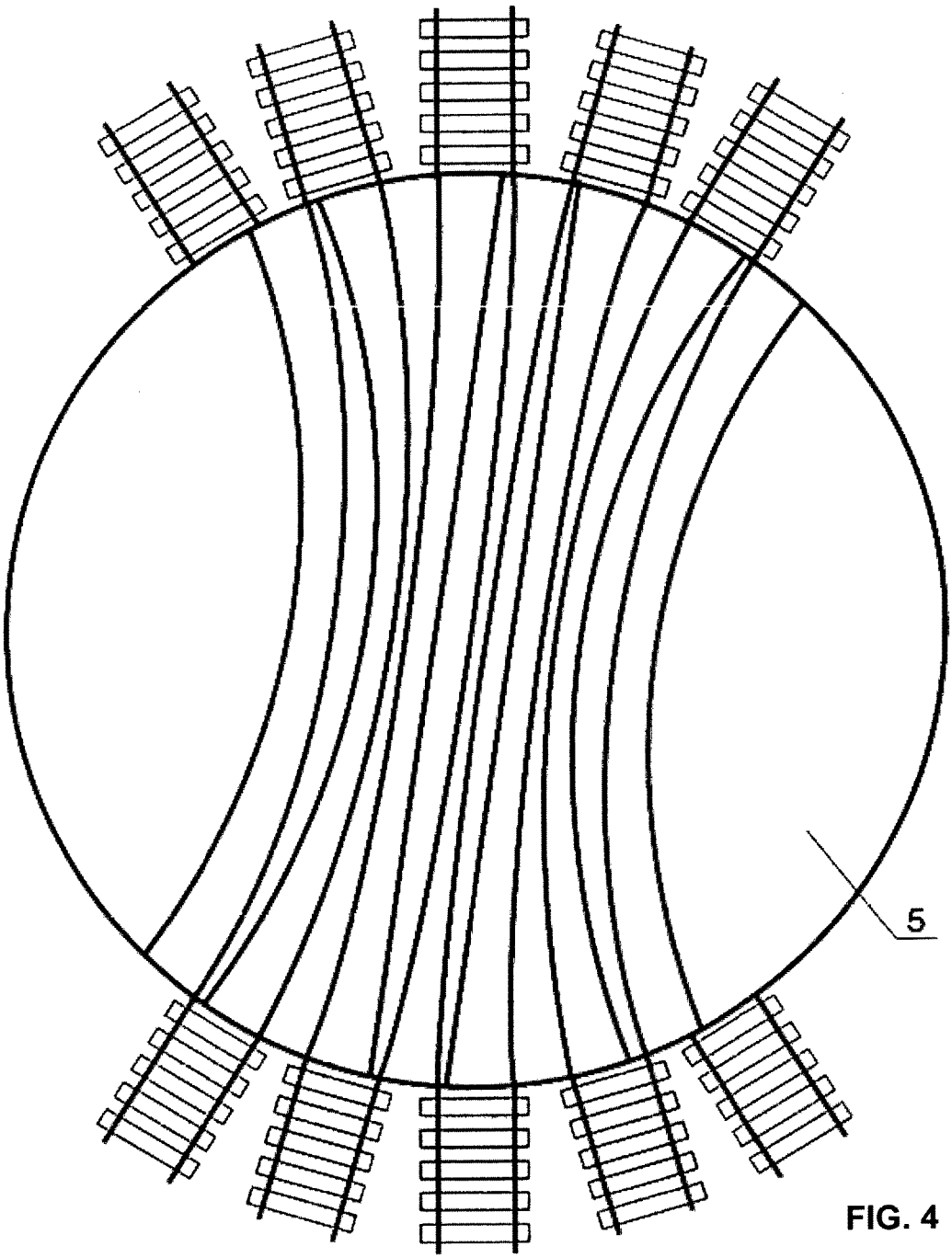
FIG. 4 illustrates a rotation platform connecting multiple incoming and outcoming tracks, in accordance with the exemplary embodiment.

FIG. 4 illustrates a rotation platform connecting multiple incoming and outcoming tracks, in accordance with the exemplary embodiment. The rotational platform 5 connects multiple incoming and outcoming tracks by rotating to a certain position.

Figure 5:
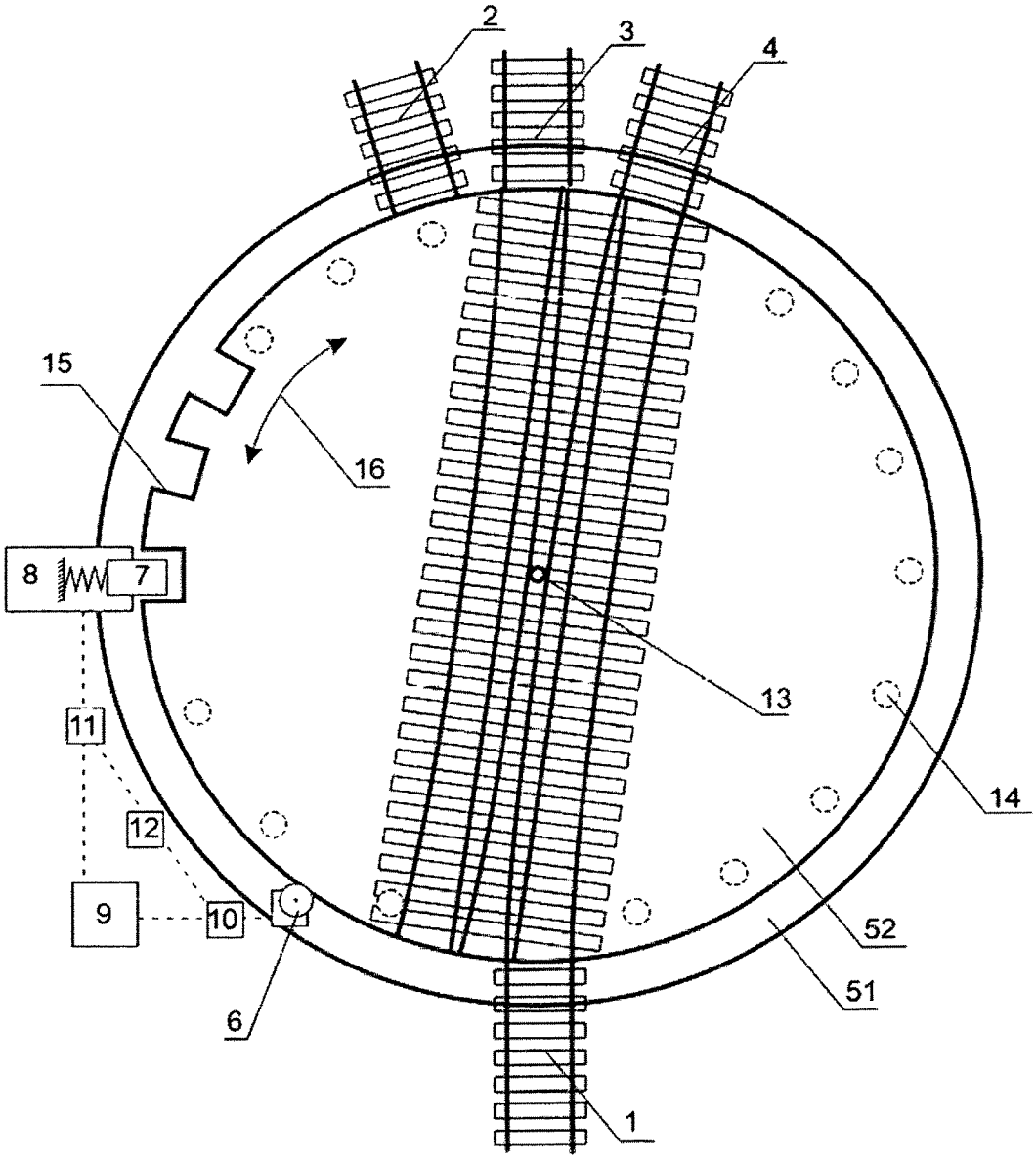
FIG. 5 illustrates a functional diagram of the automated rotational platform for the railway-switch junction, in accordance with the exemplary embodiment.

FIG. 5 illustrates a functional diagram of the automated rotational platform for the railway switch-junction, in accordance with the exemplary embodiment. The railway switch-junction is implemented as a base 51 and a rotational platform 52 positioned on it. A motor 6 serves as a rotation source for the platform 52 by engaging a rotational roller with the edge of the platform 52. Note that the base 51 and the rotational platform 52 with the motor 6 are implemented as a unit, which can be pre-assembled at the factory settings. As discussed above, the rotational platform 52 can contain multiple track segments in order to connect one incoming and one outcoming tracks.

Each track segment is assembled from standard industry rails supported by common railway sleepers. In one embodiment, the rotational platform 52 can have tracks of different width in order to connect the tracks of the different width on both sides of the switch. This can be used at the railway hubs where tracks of different size standard are used. For example, at the stations at the borders of different countries (e.g., Russia and China, or Russia and other European countries).

As discussed above, the railway tracks located on the rotational platform 52 can be implemented as grooves embedded into the platform instead of the rails. According to the exemplary embodiment, the automated rotational platform for the railway switch-junction includes a locking device 7, which is configured to lock the rotational platform 52 in each of the positions for connecting the incoming and the outcoming tracks (1 and 2, 3 or 4). The locking device 7 has its own motor (or compressor) 8 configured to engage or disengage the locking mechanism. The automated rotational platform for the railway switch-junction also includes a central control unit 9 configured to send signals (i.e., commands) to the motor 6 and to the motor 8. According to the exemplary embodiment, platform positioning sensors 10 and locking device positioning sensors 11 are also connected to the central control unit 9 for data exchange. Additionally, a signaling block 12 is connected to the sensors 10 and 11.

As discussed above, the motor 6 can be electrical or hydraulic. The rotational platform 52 can be implemented as rotational disk mounted on a central axis 13. Alternatively, the rotational platform 52 can rotate over the base 51 using a plurality of rollers or bearings positioned along the edge of the rotational platform 52. The locking device 7 can be implemented as a cone-shaped or cylindrical pin located on the platform 52 and configured to enter the openings in the base 51. In another embodiment, the locking device 7 can be implemented as a set of metal balls 14 located between the rotational platform 52 and the base 51 having a plurality of openings (or depressions) for the balls 14.

The locking device 7 uses a spring-powered pin driven into the openings 15 of the rotational platform 52. The motor 8 is configured to pull the pin out in order to unlock the platform 52. The locking device 7 (as shown) is located in horizontal plane. However, it can be implemented in a vertical plane, where the pin moves into the opening under forces of gravity rather than by being forced by the spring. In one embodiment, a gap between the rotational platform 52 and the base 51 is protected from dirt, stones and other objects by a special guard (not shown). An arrow 16 indicates that the platform can rotate in either direction.

According to the exemplary embodiment, switching between the railroad tracks is implemented as follows. For example, in the initial position, the rotational platform 52 connects the incoming track 1 to the outcoming track 2. A control signal is sent to the central control unit 9, which sends a command to the motor 8 of the locking device. The locking device unlocks the rotational platform 52. For example, a magnet lifts the pin out of the opening of the base 51. The motor 6 receives the command from the central control unit 9 and moves the rotational platform 52, which turns and connects the tracks 1 and 3. Once the tracks are connected, the locking device 7 automatically locks the platform 52. The sensors 10 and 11 send electric signals to the central control unit 9. The signaling unit 12 also receives the signals from the sensors 10 and 11 and sends an audio or visual notification signal indicating that the rotational platform 52 has moved into a new position.

The automated rotational platform for the railway switch-junction, in accordance with the exemplary embodiment, provide for the following advantages:

reliable and safe remote switching of the railroad tracks;

provides signal indicating repositioning of the track switching platform;

reduces an area of the multiple track switches at the hubs.

The automated rotational platform for the railway-switch junction is, advantageously, produced inside the factory and can be easily assembled on railway site. The system employs standard inexpensive rails and does not require any special parts made out of manganese steel used in conventional railroad switches. The proposed switch has a longer lifespan and does not require additional service once installed. The switch provides for higher train speeds going over it due to a smoother transition between the tracks. The proposed switch is environment friendly, since it does not require application of oils.

Having thus described a preferred embodiment, it should be apparent to those skilled in the art that certain advantages of the described method and system have been achieved.

It should also be appreciated that various modifications, adaptations, and alternative embodiments thereof may be made within the scope and spirit of the present invention. The invention is further defined by the following claims.

What is claimed is:

1. A system for an automated railway switch-junction, the system comprising:

a rotational platform having a plurality of railroad track segments configured to connect at least one incoming track to at least one outcoming track, wherein each of the railroad track segments located on the rotational platform comprises a pair of grooves embedded into the rotational platform and configured to accept standard railway car wheels;

a stationary base configured to support the rotational platform mounted on a central axis attached to the stationary base;

a rotational source attached to the stationary base and configured to rotate the rotational platform by a rotational roller positioned in direct contact with a side edge of the rotational platform;

a locking device positioned on the stationary base and configured to lock the rotational platform into a position for connecting the incoming and the outcoming tracks;

a locking device motor coupled to the locking device and configured to engage or disengage a locking mechanism of the locking device with the rotational platform;

a plurality of rollers and bearings positioned in-between the stationary base and the rotational platform configured to provide support and moving ability to the rotational platform;

a central control unit connected to the stationary base and configured to send commands to the rotational source and to the locking device motor in order to rotate and to lock the rotational platform;

a platform positioning sensor and a locking device positioning sensor connected to the central control unit and configured to provide data on a positioning of the rotational platform and on a state of the locking device; and a signaling block connected to the sensors and to the central control unit, the signaling block is configured to provide signals indicating position of the railway switch-junction, wherein the locking device comprises a volume filled with a rheological emulsion configured to receive electric current to turn the rheological emulsion into a solid state.

2. The system of claim 1, wherein each of the track segments located on the rotational platform comprises a pair of standard rails supported by a plurality of standard sleepers.

3. The system of claim 1, wherein the rotational source is any of:

an electric motor, a hydraulic compressor; and a mechanical manual device.

4. The system of claim 1, wherein the rotational platform is a disk rotationally attached to the central axel.

5. The system of claim 1, wherein the rotational platform is a disk supported by a plurality of bearings and rollers positioned along an edge of the rotational platform.

6. The system of claim 1, wherein the locking device comprises a cone-shaped pin configured to fit into one of a plurality of openings located in the rotational platform.

7. The system of claim 6, wherein the pin has a cylindrical shape.

8. The system of claim 6, wherein the pin is a spring-powered pin configured to lock the rotational platform by being driven into the openings in the rotational platform and to be pulled out by the locking device motor in order to unlock the rotational platform.

9. The system of claim 8, wherein the pin is configured to be pulled out of the opening by a magnet.

10. The system of claim 1, wherein the locking device comprises a plurality of metal balls located between the rotational platform and the stationary base and configured to lock the rotational platform by being placed into a plurality of depressions located in the stationary base.

* * * * *